US010794101B2

(12) United States Patent
Preising, Jr.

(10) Patent No.: US 10,794,101 B2
(45) Date of Patent: Oct. 6, 2020

(54) FLAG ANGLE METHOD FOR SUPPORTING TRACKS OF VARIOUS RADII

(71) Applicant: Overhead Door Corporation, Lewisville, TX (US)

(72) Inventor: Danny L. Preising, Jr., Massillon, OH (US)

(73) Assignee: Overhead Door Corporation, Lewisville, TX (US)

( * ) Notice: Subject to any disclaimer, the term of this patent is extended or adjusted under 35 U.S.C. 154(b) by 7 days.

(21) Appl. No.: 15/998,508

(22) Filed: Aug. 16, 2018

(65) Prior Publication Data

US 2020/0056413 A1 Feb. 20, 2020

(51) Int. Cl.
*E05D 15/26* (2006.01)

(52) U.S. Cl.
CPC ..... *E05D 15/262* (2013.01); *E05Y 2600/12* (2013.01); *E05Y 2600/626* (2013.01)

(58) Field of Classification Search
CPC ..... E05Y 2900/106; E05Y 2600/626; E05D 15/24; E05D 15/165; Y10S 16/01
See application file for complete search history.

(56) References Cited

U.S. PATENT DOCUMENTS 5,240,216 A * 8/1993 Lin ..... E05D 15/38 16/94 R
5,718,533 A * 2/1998 Mullet ..... E05D 15/24 403/393
6,554,047 B1 * 4/2003 Mondragon ..... E05D 15/24 160/188
6,561,256 B2 * 5/2003 Mullet ..... E05D 13/1215 160/191
6,739,372 B2 * 5/2004 Mullet ..... E05F 15/603 160/189
7,059,379 B2 * 6/2006 Lewis, Jr. ..... E05D 15/24 16/401
7,117,916 B2 * 10/2006 Johnston ..... E05D 15/24 160/40
7,201,207 B2 * 4/2007 Colston ..... E05D 15/165 160/201
7,254,868 B2 * 8/2007 Mullet ..... E05D 13/003 16/198
7,469,737 B2 * 12/2008 Mullet ..... E05F 15/686 160/188
7,721,387 B1 * 5/2010 Mullet ..... E05D 15/24 16/94 R
7,730,928 B2 * 6/2010 Stone ..... E05D 15/242 16/DIG. 1

* cited by examiner

*Primary Examiner* — Bradley Duckworth
(74) *Attorney, Agent, or Firm* — Haynes and Boone, LLP

(57) ABSTRACT

A flag angle includes: a body having a two ends, and a middle section located between the ends; a mounting portion on the body for mounting the body to a surface; a first wider portion located at one end, the first wider portion extending further away from the mounting portion than an amount the middle section extends from the mounting portion; a second wider portion located at the other end, the second wider portion extending further away from the mounting portion than the amount the middle section extends away from the mounting portion; first, second, third, and fourth attaching features located on the first wider portion and each of the second, third, and fourth attaching features are located progressively further away from the mounting portion; and fifth and sixth attaching features located on the second wider portion, wherein the attaching features include slots and holes.

20 Claims, 5 Drawing Sheets

FLAG ANGLE METHOD FOR SUPPORTING TRACKS OF VARIOUS RADII

TECHNICAL FIELD

This patent disclosure relates generally to support angles for supporting tracks for upward acting doors such as garage doors and, more particularly, to support angles configured to support curved tracks of various radii.

BACKGROUND

Flag angles are used to mount door tracks having a curved radius. Flag angles are called flag angles because they are an angle of metal that is typically long and thin with a wide flat section of the end which can be imagined to resemble a flag flying on a flag pole.

FIG. 1 is an example of related art where a door track assembly 114 for an upward acting door (such as, for example, a garage door) is shown. A horizontal section of track 116 is joined to a vertical section of track 118. Typically, the horizontal section of track 116 includes a curved or transition section 120 to allow the horizontal section of track 116 meet with the vertical section of track 118. However, it will be appreciated that the curved or transition section 120 could also be found on the vertical section 118 of track.

One end of a horizontal reinforcing member 124 attaches to the horizontal section of track 116 by welding or other suitable means. The other end of the horizontal reinforcing member 124 attaches to a flag angle 126 and an end bearing bracket 128 via fasteners (not shown in FIG. 1) extending through slots or holes 150 in the attaching plate 129 in the end bearing bracket 128, the horizontal reinforcing member 124 and the flag angle 126. The horizontal section of track 116 and the vertical section of track 118 are joined at the lower flag portion 140. An upper slot 142 provides structure for fasteners to attach to the horizontal section of track 116 and a lower slot 143 provides structure for fasteners to attached to the vertical section of track 118.

One drawback to the system shown in FIG. 1 is that the flag angle 126 is sized to work with a curved section of track 120 with a particular radius. The location of the attaching structure 143 and 143 on the lower flag portion 140 and, in some instances, the location of the attaching structure of the attaching plate 129 of the end bearing bracket, the horizontal reinforcing member 124, and upper flag portion 146 is configured to be compatible with curved sections of track 120 of a certain radius. If a particular installation needs a curved section 120 of a different radius, a different flag angle is used.

As such, it would be desirable to have a system and/or flag angle that would be compatible to be used with curved door tracks having various radii of curvature.

SUMMARY

The foregoing needs are met to a great extent by embodiments in accordance with the present disclosure, wherein, in some embodiments, allows a system and/or flag angle to be compatible with curved door tracks having various radii of curvature.

In one aspect, the disclosure describes a flag angle. The flag angle includes: an elongated body having a first end, a second end, and a middle section located between the first and second ends; a mounting portion on the body for mounting the body to a surface; a first wider portion located at the first end, the first wider portion extending further away from the mounting portion than an amount the middle section extends from the mounting portion; a second wider portion located at the second end, the second wider portion extending further away from the mounting portion than the amount the middle section extends away from the mounting portion; first, second, third, and fourth attaching features located on the first wider portion and each of the second, third, and fourth attaching features are located progressively further away from the mounting portion; and fifth and sixth attaching features located on the second wider portion, wherein the first, second, third, fourth, fifth and sixth attaching features include any one of the following: slots and holes defined by the first or second wider portions.

In another aspect, the disclosure describes a system for supporting door tracks of different radii. The system includes: a flag angle including: an elongated body having a first end, and a second end, and a middle section located between the first and second ends; a mounting portion on the body for mounting the body to a surface; a first wider portion located at the first end, the first wider portion extending further away from the mounting portion than an amount the middle section extends from the mounting portion; a second wider portion located at the second end, the second wider portion extending further away from the the mounting portion than the amount the middle section extends away from the mounting portion; first and second attaching features located on the second wider portion, wherein the first, and second, attaching features include any one of the following: slots and holes defined by the second wider portion. The system also includes a curved section of door track configured to be supported by the flag angle; and the first and second attaching features are located and sized to allow the first attaching features to attach to a curved section of door track having a first curve radius and the second attaching features to attach to a curved section of track having a second curve radius.

In yet another aspect, the disclosure describes a flag angle. The flag angle includes: an elongated body having a first end, and a second end, and a middle section located between the first and second ends; a mounting portion on the body for mounting the body to a surface; a first wider portion located at the first end, the first wider portion extending further away from the mounting portion than an amount the middle section extends from the mounting portion; a second wider portion located at the second end, the second wider portion extending further away from the the mounting portion than the amount the middle section extends away from the mounting portion; first and second attaching features located on the second wider portion, wherein the first attaching features are located and sized to attach to curved door tracks of a first curved radius and the second attaching features are located and sized to attach to a curved door track of a second curved radius.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION

Figure 1:
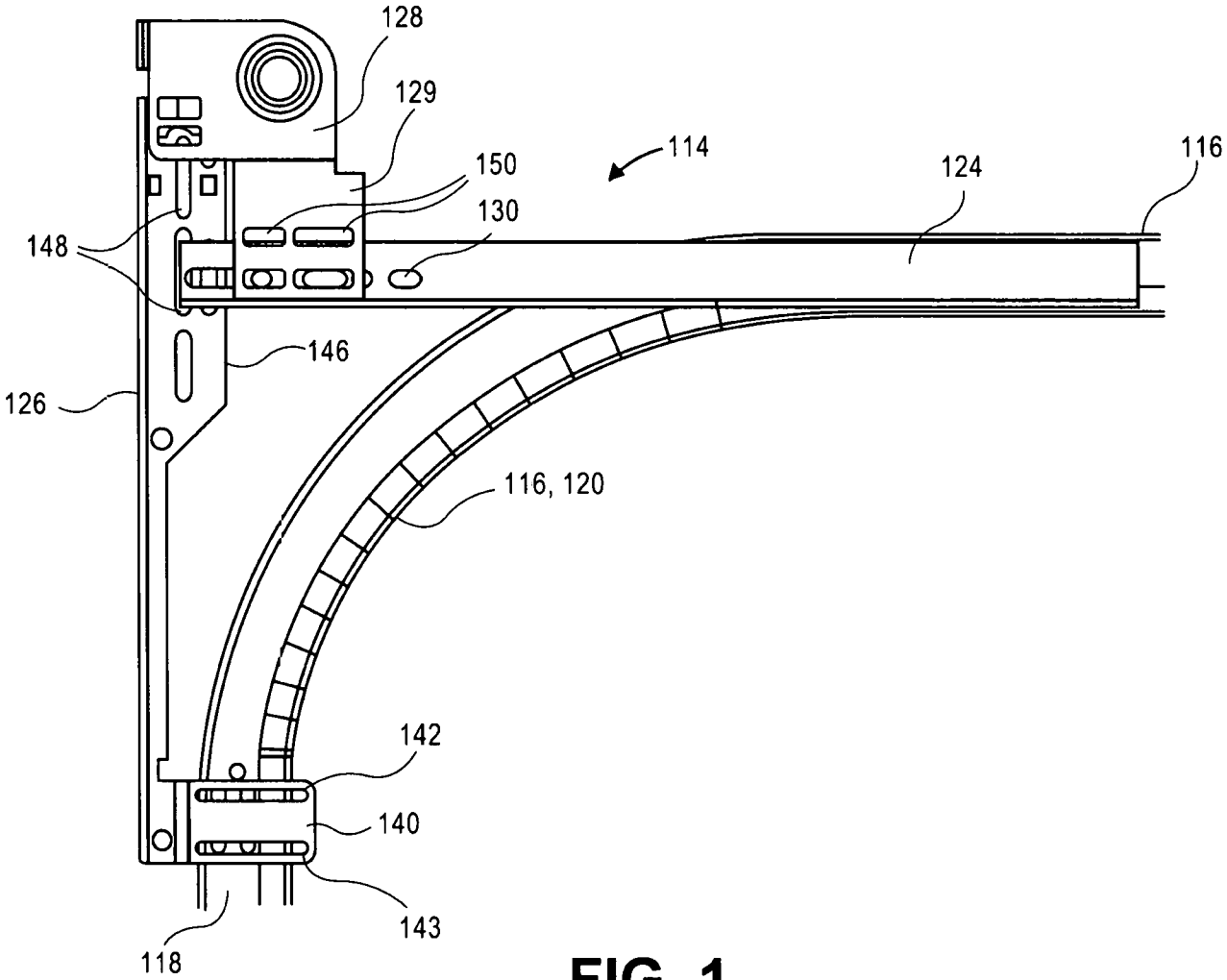
FIG. 1 RELATED ART
FIG. 1 is side view of a flag angle and system for supporting track according to the related art.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

Upward acting doors such as garage doors move along tracks. Many door tracks transition from being generally vertical to being generally horizontal. This transition is done with a curve in the tracks. Often the curve has a radius. Because different applications or different sized doors may use door tracks of different dimensions, different sets of tracks may use tracks of curve radii. For example, some tracks have a curve radius of 10, 12, and 15 inches. Other track systems may have curves with still other radii. The tracks may be mounted to a wall, ceiling and/or other support structure with a mounting system. Some current track mounting systems use different parts or structures for mounting door tracks of different curve radii. For reasons of cost, efficiency, and ease of installation, it would be desirable to have a common support structure parts that can be used with different sets of tracks having different curve radii.

Figure 2:
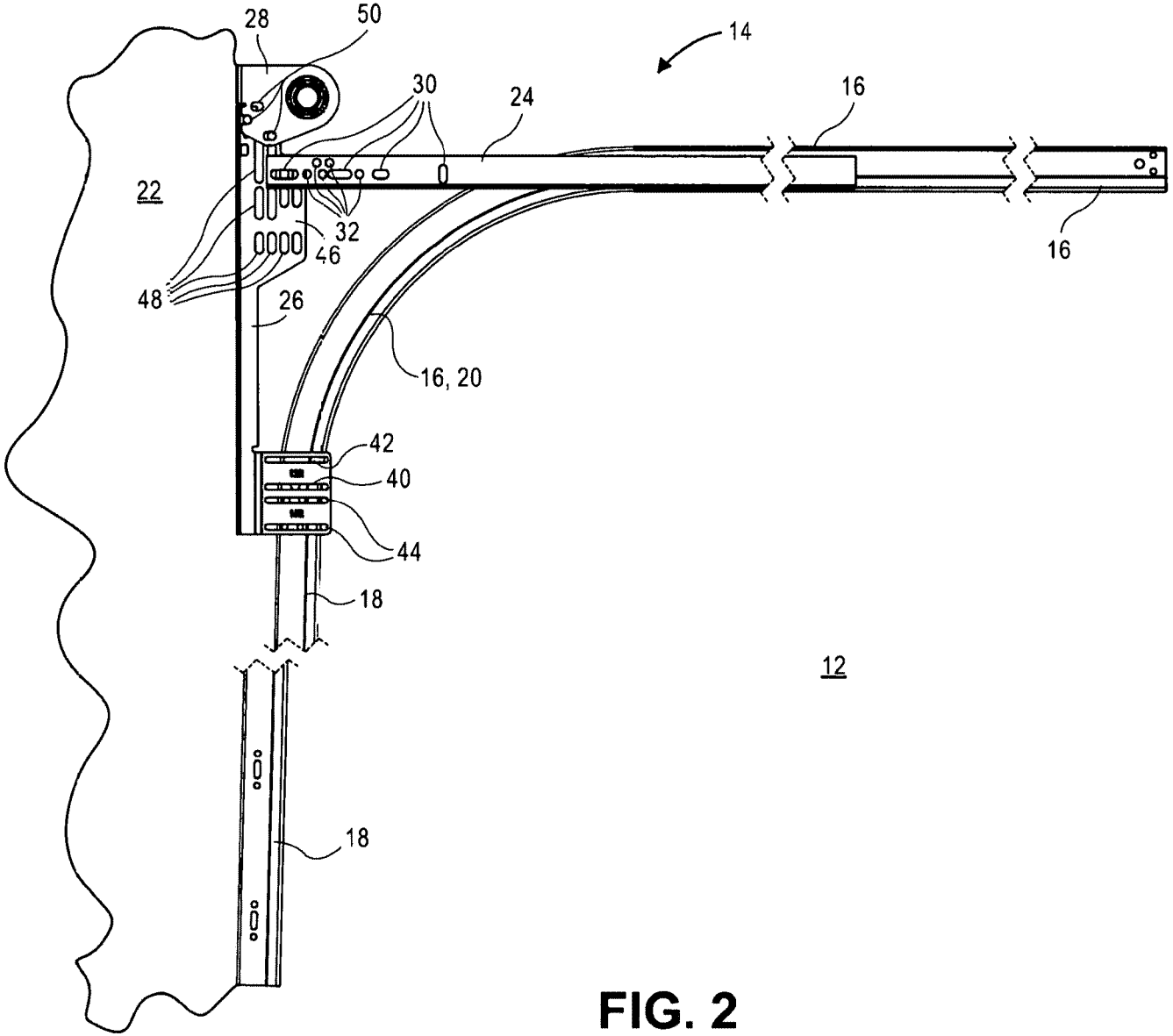
FIG. 2 is an assembled side view of a flag angle and system for supporting track according to the present disclosure.
Figure 3:
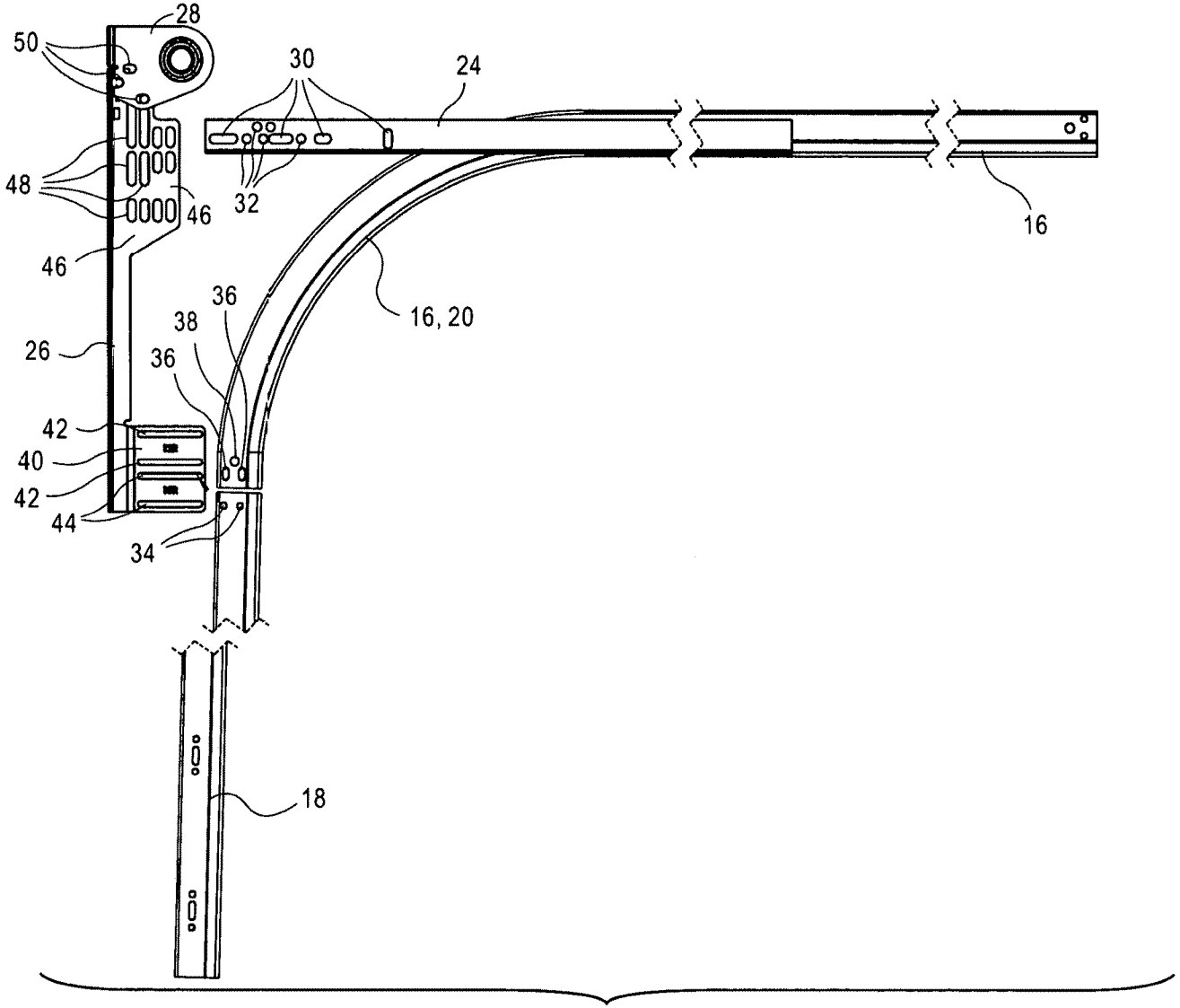
FIG. 3 is an exploded side view of the flag angle and system for supporting track according to the present disclosure.

FIGS. 2 and 3 are side views of door track assemblies 14 in accordance with the present disclosure. FIG. 2 is an assembled view and FIG. 3 is an exploded view. It will be appreciated that the various parts shown are attached to each other with fasteners, but the fasteners are not shown in order better illustrate various aspects of the parts shown in the FIGS. and to avoid overcrowding the FIGS.

As shown in FIGS. 2 and 3 the door track assemblies 14 include a horizontal track 16 and a vertical track 18. The horizontal track 16 and a vertical track 18 provide a pathway for rollers on an upward acting door (such as, but not limited to, a residential garage door). The horizontal section of track 16 is joined to the vertical section of track 18. Typically, the horizontal section of track 16 includes a curved or transition section 20 to allow the horizontal section of track 16 meet with the vertical section of track 18. However, it will be appreciated that the curved or transition section 20 could also be found on the vertical section 18 of track in some embodiments.

One end of a horizontal reinforcing member 24 may attach to the horizontal section of track 16 by welding, fasteners or any other suitable means. The other end of the reinforcing member 24 is configured to attached to a flag angle 26 via fasteners (not shown in the FIGS.) extending through slots or holes 30, 32 in the horizontal reinforcing member 24 and the attaching structure 48 in the upper wider portion 46 of the flag angle 26. The horizontal section of track 16 and the vertical section of track 18 are joined at the lower flag portion 40 with fasteners (not shown) extending through either an upper attaching structure 42 or a lower attaching structure 44 depending upon which attaching structure 42, 44 aligns with corresponding attaching structure 34, 36, 38 on the horizontal and vertical track 16 and 18.

As shown in the FIGS. the upper and lower attaching structure 42, 44 include a parallel set of slots 42, 44. In other embodiments, other types of attaching structure 42, 44 than parallel slots maybe used (such as, but not limited to, non-parallel slots, holes, snap fasteners and the like). The slots 42, 44 provide structure for fasteners to attach to the horizontal and vertical sections of track 16, 18. Typically, the upper slot of either the upper attaching structure 42 or the lower attaching structure 44 provides structure for the horizontal section of track 16 to attach to. The lower slot of either the upper or lower attaching structure 42, 44 provides structure for the vertical section of track 18 to attach to. Which set of attaching structure 44 or 42 the track sections 16 or 18 attach to is dependent upon which attaching structure 44, 42 best aligns with corresponding attaching structure 34, 36, 38 on the track sections 16, 18. Which, in turn, usually is dependent upon the radius of the curved section 20.

The end bearing bracket 28 attaches to the upper wider portion 46 of the flag angle 26 by fasteners (not shown) extending through end bearing bracket attaching structure 50 aligned with the attaching structure 48 on the upper wider portion 46 of the flag angle 26. In the embodiment shown in FIGS. 2-10, the end bearing bracket 28 is not supported or even contacted by the horizontal reinforcing member 24.

By not needing to contact the end bearing bracket 28, the horizontal reinforcing member 24 is free to move horizontally as needed to contact the upper flag portion 46 of the flag angle 26 at any one of four different sets of attaching structure 48 located on the upper flag portion 46. This may be useful when the horizontal reinforcing member 24 is used for tracks 16,18 of different radius as different radiused tracks may have the horizontal reinforcing member attach to the flag angle 24 at different horizontal distances.

Figure 4:
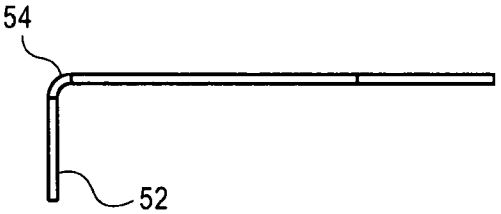
FIG. 4 is a top view of an end bearing bracket according to the present disclosure.
Figure 11:
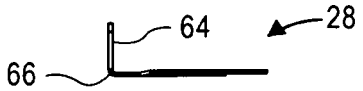
FIG. 11 is a top view of the flag angle according to the present disclosure.

FIG. 4 is a top view of a flag angle 26 in accordance with the present disclosure. The flag angle 26 includes a mounting portion 52 which is used to mount the flag angle 26 to a wall 22 (FIG. 2) or other supportive structure. The mounting portion 52 is at an angle (usually about 90 degrees) from the rest of the flag angle 26.

Figure 6:
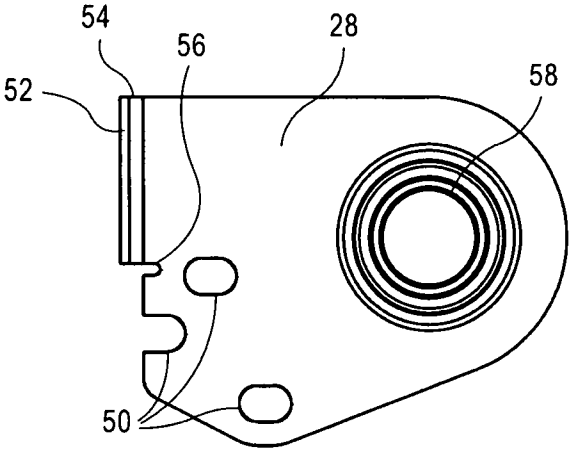
FIG. 6 is a side view of the end bearing bracket according to the present disclosure.
Figure 5:
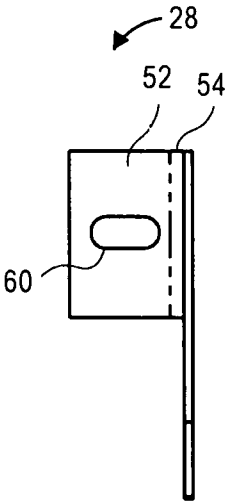
FIG. 5 is a front view of the end bearing bracket according to the present disclosure.

FIGS. 5 and 6 are side and end views of an end bearing bracket 28 according to the present disclosure. The end bearing bracket 28 has a wall mounting portion, 52 attached to the rest of the end bearing bracket 28 by a bend 54 in the material forming the end bearing bracket 28. The wall mounting portion 52 includes a mount attaching structure 60 for attaching the end bearing bracket 28 to a wall 22 or other supporting structure. As shown in FIG. 5, the mount attaching structure may include a slot for use with a fastener. Other embodiments may include a hole, snap fit attachments or any other suitable structure that allows the end bearing bracket 28 to be fit to a support structure.

In some embodiments, the end bearing bracket 28 also includes slots or holes 50 which also serve as attaching structure 50. A relief slot 56 may also be present in some embodiments. The end bearing bracket 28 may also contain an end bearing 58.

FIGS. 7-11 show the flag angle 26 at various views. The flag angle 26 has a wall or support structure mounting portion 62 for mounting the flag angle 26 to a support via the wall mounting structure 64. The wall mounting structure 64 can include holes and/or slots as shown, snap fittings or any other suitable mounting structure. The support structure mounting portion 62 is connected to the remainder of the flag angle 26 by a bend 66 in the flag angle 26.

Figure 7:
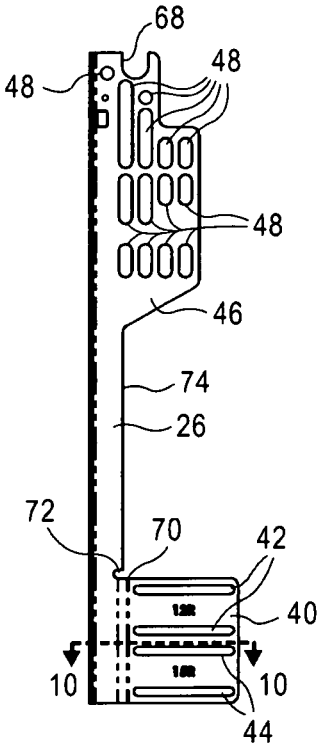
FIG. 7 is a side view of the flag angle according to the present disclosure.
Figure 8:
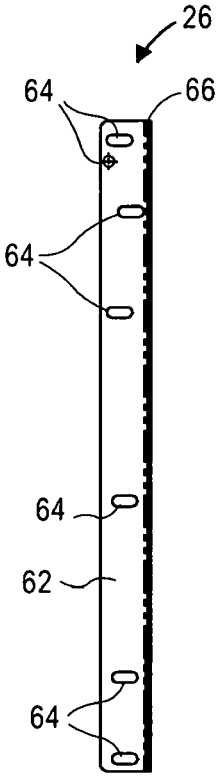
FIG. 8 is a front view of the flag angle according to the present disclosure.

The flag angle 26 has a first flag portion 46 (also referred to as a first wider portion 46) and a second flag portion 40 (also referred to as a second wider portion 40) separated by a middle portion 74. The first and second wider portions 46 and 40 are referred to as wider portions 46 and 40 because they are wider, or extend further from the support structure mounting portion 62 than the middle portion 74 as shown in FIG. 7. In the embodiment shown in FIGS. 2-11, the first wider portion 46 extends further from the support structure mounting portion 62 than the second wider portion 40. This allows the horizontal reinforcing member 24 flexibility in where it is mounted to the first wider portion 46.

Figure 9:
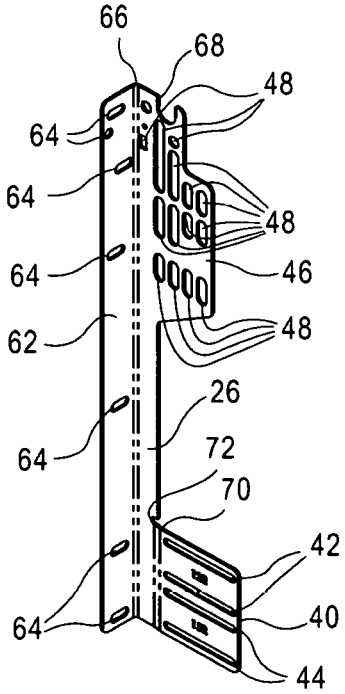
FIG. 9 is a perspective view of the flag angle according to the present disclosure.
Figure 10:
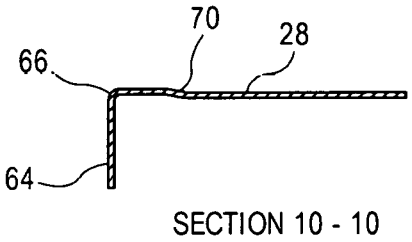
FIG. 10 is a cross-sectional view of the flag angle taken along line 10-10 of FIG. 7.

A slot 68 in the upper flag portion 46 may be present to align with the end bearing 58 (as shown in FIGS. 1 and 2). A bend 70 as shown best in FIG. 10 may be present in the flag angle 26. Some embodiments may include a relief slot 72 as shown in FIGS. 7 and 9.

It will be appreciated that the system or assembly 14 may be made of any variety of materials in accordance with the present disclosure. Any or all of the parts may be made of metal such as steel or aluminum or they may be made of plastic or the like. The attaching structure and/or other means for attaching or connecting parts described herein my include fasteners located in slots and/or holes, wielding, epoxies, adhesives, sliding connections, snap fit connections, or any other suitable structure or method for attaching parts together. Many different types of attaching structure may be used in accordance with the present disclosure.

While the disclosure has been described in terms of exemplary aspects, those skilled in the art will recognize that the disclosure can be practiced with modifications in the spirit and scope of the appended claims. These examples given above are merely illustrative and are not meant to be an exhaustive list of all possible designs, aspects, applications or modifications of the disclosure.

I claim:

1. A flag angle comprising:

an elongated body having a first end, and a second end, and a middle section located between the first and second ends;

a mounting portion on the body for mounting the body to a surface;

a first wider portion located at the first end, the first wider portion extending further away from the mounting portion than an amount the middle section extends from the mounting portion;

a second wider portion located at the second end, the second wider portion extending further away from the mounting portion than the amount the middle section extends away from the mounting portion;

and first and second attaching features located on the second wider portion, wherein each the first and second attaching features comprises an upper horizontal slot and a lower horizontal slot, wherein the upper horizontal slot of the first attaching feature is located and sized to attach to curved door tracks of a first curved radius and the upper horizontal slot of the second attaching feature is located and sized to attach to a curved door track of a second curved radius; and third, fourth, fifth, and sixth attaching features located on the first wider portion, wherein each of the third, fourth, fifth, and sixth attaching features is located progressively further away from the mounting portion and comprises at least one slot.

2. The flag angle of claim 1, wherein the upper and lower horizontal slots of the first attaching feature are located further away from the second end than the upper and lower horizontal slots of the second attaching feature.

3. The flag angle of claim 1, wherein the second wider portion extends further away from the mounting portion than the first wider portion extends away from the mounting portion.

4. The flag angle of claim 1, wherein the slots of the third, fourth, fifth, and sixth attaching features are extend vertically.

5. The flag angle of claim 1, wherein the first wider portion extends at least 50% a length the second wider portion extends from the mounting portion.

6. The flag angle of claim 1, wherein the mounting portion is at a right angle with respect to the first and second wider portions and the middle section.

7. The flag angle of claim 1, wherein one of the third, fourth, fifth, and sixth attaching features include a slot of a different length than any other slot of the other of the third, fourth, fifth, and sixth attaching features.

8. The flag angle of claim 1, wherein the upper and lower horizontal slots of the first attaching feature and the second attaching feature have a common length.

9. A system for supporting door tracks of different radii comprising:

a flag angle including:

an elongated body having a first end, and a second end, and a middle section located between the first and second ends;

a mounting portion on the body for mounting the body to a surface;

a first wider portion located at the first end, the first wider portion extending further away from the mounting portion than an amount the middle section extends from the mounting portion;

a second wider portion located at the second end, the second wider portion extending further away from the mounting portion than the amount the middle section extends away from the mounting portion; and first and second attaching features located on the second wider portion, wherein each of the first and second attaching features comprises a pair of slots defined by the second wider portion and extending parallel to a direction that the second wider portion extends from the mounting portion; and a first curved section of door track configured to be supported by the flag angle;

wherein the first and second attaching features are located and sized to allow an upper slot of the first attaching features to attach to the first curved section of door track having a first curve radius and an upper slot of the second attaching features to attach to a second curved section of track having a second curve radius different than the first curve radius.

10. The system of claim 9, further comprising a horizontal reinforcing member configured to attach to the flag angle at the first wider portion and an end bearing bracket spaced apart from the horizontal reinforcing member.

11. The system of claim 10, wherein the end bearing bracket is dimensioned to not contact the horizontal reinforcing member when the end bearing bracket and the horizontal reinforcing member are attached to the flag angle.

12. The system of claim 9, further comprising: third, fourth, fifth, and sixth attaching features located on the first wider portion and each of the third, fourth, fifth, and sixth attaching features are located progressively further away from the mounting portion.

13. The flag angle of claim 9, wherein the first wider portion extends at least 50% of a length the second wider portion extends from the mounting portion.

14. The flag angle of claim 12, wherein the third, fourth, fifth and sixth attaching features include parallel slots that are oriented at 90 degrees from the parallel slots of the first and second attaching features.

15. A flag angle comprising:

an elongated body having a first end, and a second end, and a middle section located between the first and second ends;

a mounting portion on the body for mounting the body to a surface;

a first wider portion located at the first end, the first wider portion extending further away from the mounting portion than an amount the middle section extends from the mounting portion;

a second wider portion located at the second end, the second wider portion extending further away from the mounting portion than the amount the middle section extends away from the mounting portion;

first and second attaching features located on the second wider portion, the first attaching features disposed further from the second end than the second attaching features, each of the first and second attaching features comprising a pair of parallel slots oriented parallel to a direction in which the second wider portion extends from the mounting portion, wherein an upper slot of the first attaching features is located and sized to attach to a curved door track of a first curved radius when a lower slot of the first attaching features is attached to a first vertical track, and an upper slot of the second attaching features is located and sized to attach to a curved door track of a second curved radius when a lower slot of the second attaching features is attached to a second vertical track; and third, fourth, fifth, and sixth attaching features located on the first wider portion, wherein each of the third, fourth, fifth, and sixth attaching features are located progressively further away from the mounting portion and comprises a set of three linearly arranged slots, and wherein at least one slot of the third and fourth attaching features has a length that is different than a length of at least one other slot of the third and fourth attaching features, respectively.

16. The flag angle of claim 15, wherein the first wider portion extends at least 50% of a length the second wider portion extends from the mounting portion.

17. The flag angle of claim 15, wherein each slot of the fifth and sixth attaching features has a first common length.

18. The flag angle of claim 17, wherein a lower slot of each of the third and fourth attaching features has a second common length.

19. The flag angle of claim 18, wherein a middle slot of each of the third and fourth attaching features has a third common length which is greater than the first and second common lengths.

20. The flag angle of claim 19, wherein an upper slot of each of the third and fourth attaching features has a fourth common length which is greater than the first, second, and third common lengths.

* * * * *